United States Patent [19]

Landers

[11] Patent Number: 4,930,685

[45] Date of Patent: Jun. 5, 1990

[54] ICE DISPENSING APPARATUS AND METHOD

[75] Inventor: Jerry L. Landers, Jeffersonville, Ind.

[73] Assignee: SerVend International, Inc., Jeffersonville, Ind.

[21] Appl. No.: 160,753

[22] Filed: Feb. 26, 1988

[51] Int. Cl.[5] ..... G01F 11/10

[52] U.S. Cl. ..... 222/370; 222/242; 62/381; 221/263

[58] Field of Search ..... 222/240, 368, 369, 146.6, 222/242, 370, 274; 221/277, 263, 266; 62/381, 344, 266

[56] References Cited

U.S. PATENT DOCUMENTS

| | | | |
|---|---|---|---|
| 1,290,090 | 7/1919 | Cole | 222/368 |
| 1,613,831 | 1/1927 | Huntington et al. | 222/369 |
| 2,111,485 | 3/1938 | Boykin | 222/369 |
| 3,211,338 | 10/1965 | Weil et al. | 222/146.6 |
| 3,272,300 | 9/1966 | Hoenisch | 222/369 |
| 3,387,750 | 6/1968 | Stencil | 62/266 |
| 3,580,428 | 5/1971 | Garber | 222/241 |
| 3,592,366 | 7/1971 | Markley et al. | 222/408 |
| 3,798,923 | 3/1974 | Pink et al. | 222/370 |
| 3,874,559 | 4/1975 | Pink | 222/146.6 |
| 3,881,642 | 5/1975 | Hoenisch | 222/370 |
| 4,049,161 | 9/1977 | Kohl | 222/233 |
| 4,123,918 | 11/1978 | Kohl et al. | 62/320 |
| 4,423,830 | 1/1984 | Lents et al. | 222/146 C |

FOREIGN PATENT DOCUMENTS

| | | | |
|---|---|---|---|
| 685180 | 9/1979 | U.S.S.R. | 221/263 |

*Primary Examiner*—Michael S. Huppert
*Assistant Examiner*—Kenneth Noland
*Attorney, Agent, or Firm*—James Creighton Wray

[57] ABSTRACT

An ice dispensing bin has an inward and rearward sloped front wall and a downward and forward sloped semi-cylindrical bottom wall. The rear wall and side walls and an upper portion of the front wall are generally vertical. A paddle wheel is positioned in a recess in the sloping front wall. The paddle wheel has a circular plate lying along a central portion of the annular recess. A truncated conical plate converges axially about 10 degrees from the circular plate. Paddles extend radially from the conical plate. Turbine blade-like paddles curve circumferentially and then axially and stop short of the front wall to trap and move ice along the front wall of the recess as the paddle wheel is rotated. A shaft extends through the paddle wheel and rearwardly to a bearing in the rear wall. An angular arm on the shaft breaks ice bridges as the shaft rotates with the paddle wheel. A speed reducer mounted on the front of the sloping wall and a motor mounted on a lower portion of the speed reducer turn the paddle wheel and ice bridge breaker. A switch opens the gate and starts movement of the paddle wheel.

47 Claims, 3 Drawing Sheets

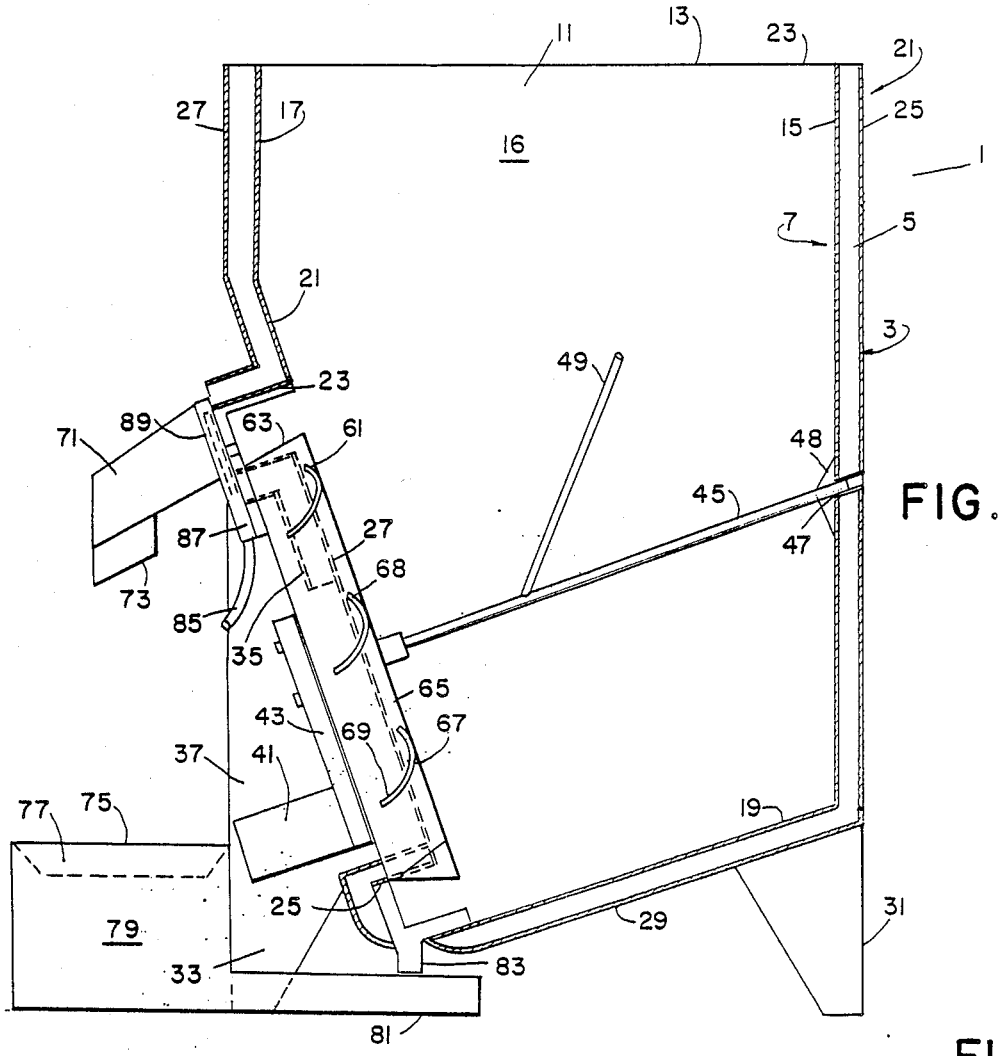
FIG. 1
FIG. 2
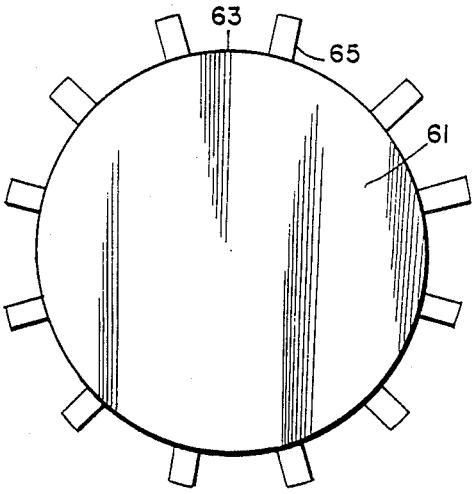
FIG. 3
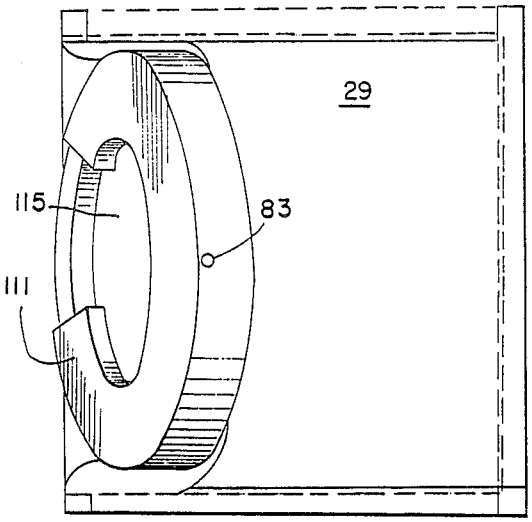

FIG. 5
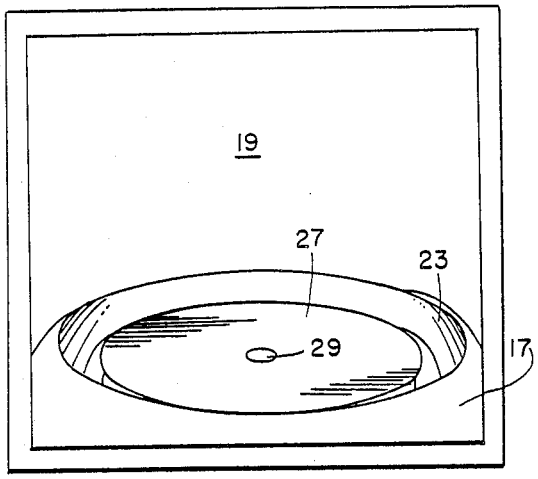
FIG. 4
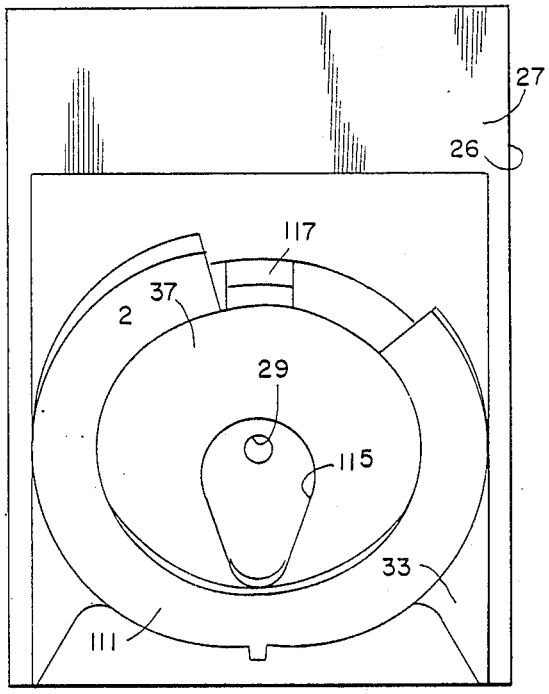
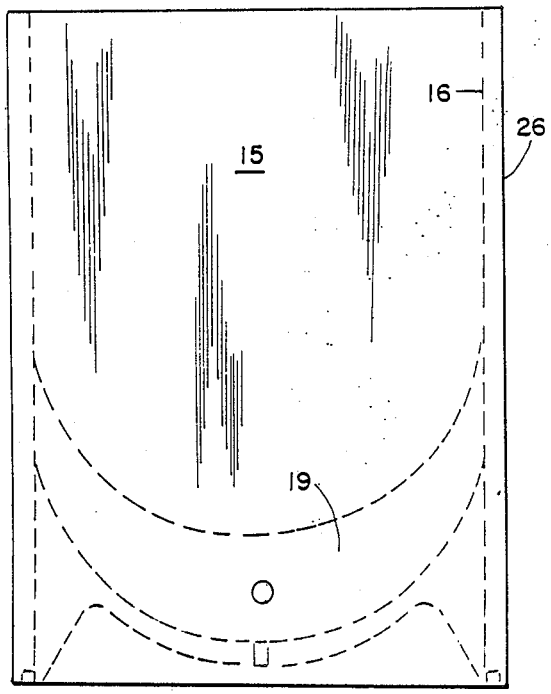
FIG. 7
FIG. 6
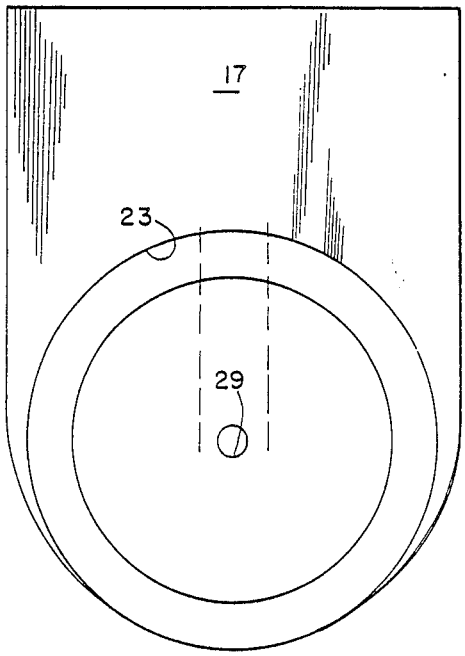

ICE DISPENSING APPARATUS AND METHOD

BACKGROUND OF THE INVENTION

The present invention relates to ice dispensing. Several problems exist in the ice dispensing art.

One of the primary considerations is the desireability of storing as much dispensable ice as possible in the smallest space. Space is defined by available floor or countertop space. Prior art ice dispensers require the hopper to be above the delivery chute and above the cup, bag or bucket which is to be filled. The hopper position is required to be above a convenient height for filling containers. The storage bins or hoppers of ice cube dispensers usually must be elevated to ensure dispensing a reasonable amount of the stored ice. Elevation makes the space under the hopper unavailable for storing ice. In addition, elevating the hopper places a heavy weight at a height which results in a need for a tall, strong base which is necessary to support the hopper and the weight of its contents. It is highly desirable to dispense all of the ice available in a bin. That is not possible in some bins of the prior art.

It is desirable to have an even ice flow which starts and stops as the dispenser is turned on and off. Some prior art devices tend to deliver ice in irregular ice flows.

It is desirable to have a dispenser with motors and moving parts which are easily accessible. Some machines have motors and drives which are difficult to access.

The present invention overcomes disadvantages of the prior art.

SUMMARY OF THE INVENTION

In the present invention an ice dispensing bin has an inward and rearward sloped front wall and a downward and forward sloped semi-cylindrical bottom wall. The rear wall and side walls and an upper portion of the front wall are generally vertical. A paddle wheel is positioned in a recess in the sloping front wall. The paddle wheel has a circular plate lying along a central portion of the annular recess. A truncated conical plate converges axially about 10 degrees from the circular plate. Paddles extend radially from the conical plate. Turbine blade-like paddles curve circumferentially and then axially and stop short of the front wall to trap and move ice along the front wall of the recess as the paddle wheel is rotated. A shaft extends through the paddle wheel and extends rearwardly to a bearing in the rear wall. An angular arm on the shaft breaks ice bridges as the shaft rotates with the paddle wheel. A speed reducer mounted on the front of the sloping wall and a motor mounted on a lower portion of the speed reducer turn the paddle wheel and ice bridge breaker. A switch opens the gate and starts movement of the paddle wheel.

The present invention uses a paddle wheel to lift ice from a bottom of a bin. More than 99 percent and usually substantially all of the ice cubes present in a U-shaped bin are dispensed by using the wheel with paddles, which are spaced closely to the curvature of the bottom.

In one embodiment, a bin bottom slopes forward at about 10 to 20 degrees, and the front wall slopes upward and forward about 5 to 20 degrees. The latter slope allows positioning of a gear motor adjacent the sloping front wall within the rectangular planform of the outer cabinet. A paddle wheel is directly driven by a shaft which extends through the front wall. Paddles are oriented about 45 degrees to an axial direction at about 45 degrees to a tangential direction. As the paddle wheel turns clockwise, the sloping paddles trap the ice against the front wall, as they lift the ice to a dispensing opening in the front wall at the top of the wheel. In one embodiment, the top half of the wheel is covered, and the lower half of the wheel is exposed within the bin. An agitator is angled rearward to break up ice bridges.

In one preferred embodiment, the paddle wheel is located in a recess in the bin front wall. As the wheel turns, a solenoid-controlled door opens to allow ice dispensing. The bottom of the ice hopper and the front bin wall are angled at 20 degrees from horizontal and vertical, respectively.

A preferred form of an ice dispenser has a paddle wheel mounted on a shaft. Circular means are connected to the shaft for supporting peripheral ice-moving means. Peripheral means are connected to a circumference of the circular means for supporting ice-moving means, and ice-moving means are connected to the peripheral means and extend outward therefrom. Preferably the ice-moving means comprise ice-moving blades connected to the peripheral means and positioned at angles relative to the shaft.

In a preferred form of the invention, the blades extend in curved surfaces which curve generally axially and then forward. Preferably, the curved surfaces extend at angles to tangential and axial directions.

A preferred paddle wheel has a circular plate and a truncated plate attached to and extending forward of a circumferential area of the circular plate. The blades are attached to the conical plate and curve rearward in a direction of rotation of the circular plate and then curve axially forward. In one form of the invention, the blades are flexible and forward portions of the blades may resiliently move.

Preferably, the blades terminate short of a front edge of the conical plate.

In a preferred embodiment, the circular plate of the paddle-wheel fits against a circular portion of a front wall of an ice dispenser bin. The conical plate surrounds a cylindrical wall portion of a recess in the front wall of the bin, and the blades move within the recess. Preferably, there is a drain at the bottom of the recess in the front wall and dispensing in the front wall at the top of the recess.

In a preferred bin, the front wall slopes rearwardly and inwardly from an upper portion.

Preferably, the front wall is sloped rearwardly and inwardly about 20 degrees with respect to vertical. A solenoid-operated gate is positioned in front of the opening. The gate moves from an open position to a closed position blocking the opening.

The preferred ice dispenser has an external recess in the outside of the front wall, which is located within the cylindrical recess in the inside of the front wall of the bin. A motor and gear drive are mounted within the external recess and are connected to the shaft which drives the paddle wheel.

Preferably, an ice bridge breaker angularly extends from the shaft which extends within the bin. The preferred ice bridge breaker comprises an extension shaft extending axially rearward from the paddle wheel shaft and drivingly connected thereto. The bin rear wall has an end support for a distal end of the extension shaft. An ice bridge breaker arm is connected angularly to the extension shaft.

The present invention provides an ice dispenser bin having generally vertical side walls connected to the front wall and having a curved bottom wall connected to the side walls and front wall. The bottom wall slopes downward and forward toward the front wall. A rear wall extends generally upwardly from the bottom wall and is connected to the side walls. The bottom wall curves and generally tangentially joins the side walls.

Preferably, the bottom wall slopes downwardly from the rear wall to the front wall. In one embodiment, the bottom curvature is slightly greater than an outer curvature of the recess in the front wall.

The present invention provides ice dispenser apparatus with a bin having a rear wall, side walls, a bottom wall and a front dispensing wall. The front wall has a curved forward extending recess communicating with the bin. Paddle means are positioned in the recess, and drive means are connected to the paddle means for moving the paddle means in the recess. A dispensing opening at the top of the recess in a front portion thereof is selectively closed by a door.

The preferred recess is generally circular. The preferred driving means is a shaft extending through the front wall in the center of the circular recess. A connecting means connects the paddles to the shaft. preferably, the connecting means is a plate connected to the shaft and overlying the front wall in an area surrounding the annular recess. paddles extend into the recess from the plate.

EXAMPLE 1

One form of the invention is a 22" wide×28" deep×30" high countertop ice dispenser with 165 pounds of ice storage. The unit stores approximately 66 percent more ice in the same space than existing products.

From a construction standpoint, the device is front driven by a direct drive motor. There is one lifting device which both delivers and agitates the ice.

All of the ice in the bin is dispensed with the possible exception of one or two cubes. The ice dispense rate is a consistent 4.5 ounces per second.

Two-thirds more ice is stored in the same space than in previous products. Two-thirds fewer trips are required to manually fill the ice dispenser.

This product is intended for use in fast food restaurants, convenience stores, cafeterias, and the like.

EXAMPLE 2

A bulk ice dispenser/bagging dispenser is 30" wide, 35" deep, and 60" tall. The unit stores 400 pounds of ice with an ice dispensing speed of approximately two pounds per second. The unit is designed to replace open bins which require physical scooping of the ice.

The device represents a sanitary method of bulk ice dispensing. Current societal concerns over infectious diseases make this device preferable over a scoop-out ice bin. This device also offers the user considerable labor savings.

The present dispenser holds approximately the same ice storage in the same physical space as an open bin. The reduction in parts of the present invention has significantly narrowed the cost difference between an open bin and present bulk dispensers.

The two pound per second dispensing speed of the device is consistent for the entire storage. As such, substantial labor savings can be realized when contrasting the invention to existing scoop-out bins. Emptying the contents of the new dispenser (about 400 pounds when an ice maker shuts off) into five gallon buckets takes approximately 5½ minutes. Physically scooping the same amount of ice out of an open bin takes about 10 minutes. As such, the invention represents a labor savings of about 50 percent relative to scooping ice. A decreased minimum wage population compiled with high turnover rates for this wage classification intensify the importance of labor saving devices.

The advantages of the dispenser are especially realized when used as an ice bagger. A larger potential exists to replace any 30" wide ice bin. The labor savings and sanitation improvements that the invention represents are applicable to any food service application.

These and further and other objects and features of the invention are apparent in the disclosure which includes the specification and which is the foregoing and ongoing written description, including the claims, and the drawings.

BRIEF DESCRIPTION OF THE DRAWINGS

FIG. 1 is a cross-sectional view showing a preferred embodiment of the invention.

FIG. 2 is a schematic detail of a paddle wheel.

FIG. 3 is a bottom view of the ice bin shown in FIG. 4.

FIG. 4 is a front view of the ice bin.

FIG. 5 is a top view of the ice bin.

FIG. 6 is a view of the front wall of the bin in an axial direction of the shaft and the recess.

FIG. 7 is a rear view of the dispenser showing the bin in hidden lines.

DETAILED DESCRIPTION OF THE DRAWINGS

Figure 8:
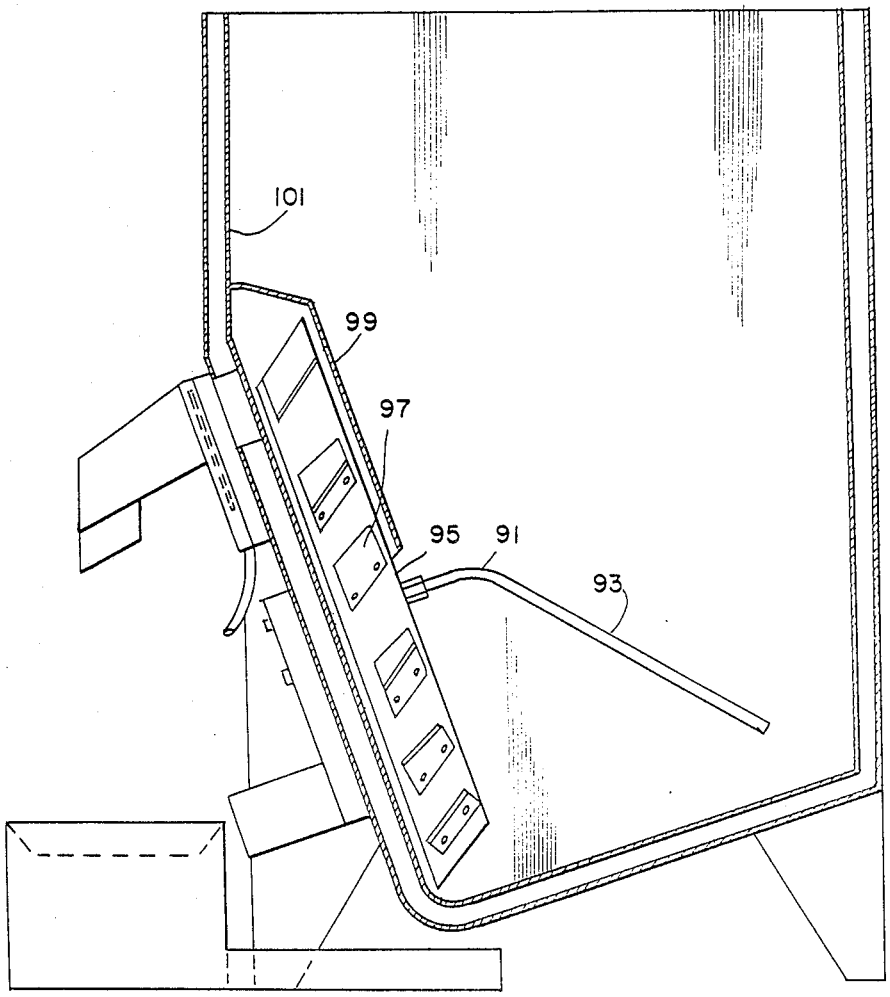
FIG. 8 is a cross-sectional side view of another embodiment.

Referring to FIG. 1, an ice dispenser is generally indicated by the numeral 1. The ice dispenser has a bin with an outer wall 3 and an inner wall 7 separated by insulation 5. The bin 11 has an open top 13 on which a cover may be placed or on which an ice making machine may be placed. A rear wall 15 and side walls 16 are generally vertical. The upper portion 17 of a front wall is generally vertical. A bottom wall 19 slopes downwardly and forwardly at an angle of about 20 degrees. The major portion 21 of the front wall slopes rearwardly and downwardly at an angle of about 20 degrees from the vertical.

A recess 23 is formed in the front wall. The recess has a generally cylindrical form. The recess has an inner cylindrical wall 25. A generally flat circular wall area 27 is surrounded by the recess 23.

The outer bottom wall 29, as shown in FIGS. 1 and 3, is supported on legs 31 and 33 which extend downward. The outer surface 35 of the front wall has a recess 37 which receives the driving parts. A motor 41 and a speed reducing gear drive 43 are directly connected to a shaft 45 which extends through the front wall and into a bearing 47 and a support 48 in the rear wall. An ice breaker 49 is angularly connected to the shaft and moves through the bin II to break ice bridges.

A paddle wheel 61 has a truncated conical portion 63 which fits within the recess 23 in the front wall. A circular plate portion 65 connects the conical portion 63 to the shaft 45. Blades 67 are mounted exteriorly on the conical portion 63. Leading portions 68 of blades 67 curve toward the front wall. The slight forward curve prevents the shaving or crushing of ice, reduces resistance to turning by the stored ice, and reduces torque requirement for driving the paddle wheel. Blades 67 extend rearwardly in the direction of rotation of the paddle wheel 61 and forwardly to forward ends 69 which are spaced slightly from the front wall of the dispenser. The curved paddles and the truncated conical shape of outer portion 63 of the paddle wheel ensure that ice cubes captured by the paddle wheel move toward the front wall.

A chute 71 has a spout 73 which is configured for filling containers with ice Which are positioned on shelf 75. A grid 77 allows ice cubes to fall into drain 79. Melt water discharges into the main drain 81.

A drain 83 is connected into the lower portion of the recess in the front wall. A drain tube 85 drains the frame 87 in which the solenoid-operated door 89 moves.

Figure 9:
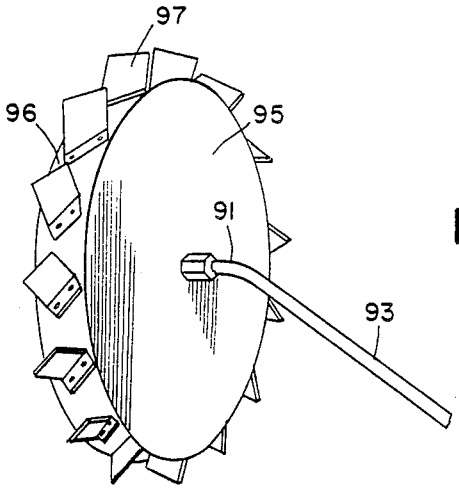
FIG. 9 is a detail of an alternate paddle wheel.

An alternate form of the invention is shown in FIGS. 8 and 9 in which shaft 91 has its rear free end 93 bent to break ice bridges within the bin. The bin is shaped similarly to the bin shown in FIG. 1 with the exception that no recess is provided in the front wall.

Shaft 91 is connected to a paddle wheel 95 with paddles 97 mounted on a frustoconical wall 96. Because there is no recess in the front wall 101 in the bin, a shroud 99 is provided over the upper half of the paddle wheel 95. The sloped paddles 97 capture ice cubes against the front wall and move the ice cubes upward into the dispensing opening in the front wall which connects with the chute.

Bottom, front and top views of the bin are shown in FIGS. 3, 4 and 5.

As shown in FIG. 3, the outer surface 111 of the front wall has a central recessed area 115 which is used for mounting the motor and drive, as shown in FIG. 4. Area 117 in FIG. 4 shows the opening in the front wall through which ice is dispensed. 29 shows the opening in the front wall through which the drive shaft passes.

FIG. 6 is a view of the front wall 17 taken along the axis of opening 29 and recess 23.

FIG. 7 shows a view of the rear wall 15 and shows the shape of the bottom wall 19 which slopes forwardly from the rearward limits.

While the invention has been described and claimed with reference to specific embodiments, modifications and variations of the invention may be constructed without departing from the scope of the invention which is defined in the following claims.

I claim:

1. An ice dispensing paddle wheel comprising a shaft, circular means connected to the shaft for supporting peripheral means, peripheral means connected to a circumference of the circular means for supporting ice-moving means, and ice-moving means connected to the peripheral means and extending outward therefrom, the ice-moving means comprising ice-moving blades connected to the peripheral means and being positioned at angles relative to the shaft, wherein the blades extend in curved surfaces which curve generally rearwardly with respect to shaft rotation and then axially with respect to the shaft, whereby the paddles urge the ice to move forwardly in the direction of shaft rotation and in front of the blades and urge the ice to move axially forwardly with respect to the shaft as the shaft, circular means, peripheral means and ice-moving blades move, wherein the circular means comprises a circular plate and wherein the peripheral means comprises a truncated conical plate attached to and extending forward of a circumferential area of the circular plate, and wherein the blades are attached to the truncated conical plate and wherein the blades curve rearward in a direction of rotation of the circular plate and axially, wherein the circular plate fits against a circular portion of a front wall of an ice dispenser bin, wherein the conical plate surrounds a cylindrical wall portion of a recess in the front wall of the ice dispenser bin and wherein the blades move within the recess.

2. The apparatus of claim 1 further comprising a drain at the bottom of the recess in the front wall and an opening at the top of the recess in the front wall.

3. The apparatus of claim 2 wherein the front wall is sloped rearwardly and inwardly in the bin.

4. The apparatus of claim 3 wherein the front wall is sloped rearwardly and inwardly about 20 degrees with respect to vertical.

5. The apparatus of claim 3 further comprising a solenoid operated gate in front of the opening, the gate moving from an open position to a closed position in front of the opening.

6. The apparatus of claim 3 further comprising a recess in the outside of the front wall within the cylindrical recess in the inside of the front wall and further comprising a motor and gear drive mounted within the external recess and connected to the shaft.

7. The apparatus of claim 6 further comprising an ice bridge breaker angularly extending from the shaft within the bin.

8. The apparatus of claim 7 wherein the ice bridge breaker comprises an extension extending rearward from the paddle wheel shaft and drivingly connected thereto and a rear wall and a support for a distal end of the extension mounted on the rear wall and an ice bridge breaker arm angularly connected to the extension.

9. The apparatus of claim 3 further comprising an ice dispenser bin having generally vertical side walls connected to the front wall and having a curved bottom wall connected to the side walls and front walls, the bottom wall sloping downward and forwardly toward the front wall, and having a rear wall extending generally upwardly from the bottom wall and connected to the side walls and wherein the bottom wall is curved and generally tangentially joins the side walls.

10. The apparatus of claim 9 wherein the bottom wall slopes downwardly from the rear wall to the front wall.

11. Ice dispenser apparatus comprising a bin having a rear wall, side walls, a bottom wall and a front dispensing wall, wherein the front wall has a curved forward extending recess communicating with the bin and extending forward in the front wall and further comprising paddle means positioned in the recess and drive means connected to the paddle means for moving the paddle means in the recess, an opening at the top of the recess in a front portion thereof and means for selectively closing and opening, whereby the paddles move in the recess and move ice along the recess toward an opening in the front dispensing wall.

12. The apparatus of claim 11 wherein the recess is generally circular and wherein the driving means comprises a shaft extending through the front wall in the center of the circular recess and connecting means connecting the paddles to the shaft.

13. The apparatus of claim 11 wherein the recess is generally annular and wherein the driving means comprises a shaft extending through a center of the annular recess, a plate connected to the shaft overlying the front wall in an area within the annular recess and paddles extending into the recess from the plate.

14. The apparatus of claim 13 further comprising a truncated conical plate extending into the recess from a peripheral circumferential area of the circular plate and wherein the paddles are connected to the conical plate and the circular plate and extend over the conical plate in a direction sloping generally rearwardly with respect to a direction of rotation of the shaft and forwardly with respect to the bin.

15. The apparatus of claim 14 wherein leading edges of the paddles are curved slightly forwardly with respect to the bin, for avoiding shaving or crushing ice and for reducing resistance to rotation.

16. The apparatus of claim 14 wherein the paddles are curved and are cantilevered from the conical plate and wherein the paddles extend forwardly to positions spaced from the opening.

17. The apparatus of claim 11 wherein the bottom wall of the ice hopper is curved and slopes forwardly and downwardly at an angle of about 10 to 20 degrees to horizontal.

18. The apparatus of claim 17 wherein the front wall recess is cylindrically shaped and wherein the bottom wall curvature is substantially semi-circular and wherein the front wall slopes forwardly and upwardly from the bottom wall at an angle of about 10 to 20 degrees to vertical.

19. Ice dispenser apparatus comprising a bin having a rear wall, side walls, a bottom wall and a frong ice-contacting dispensing wall, wherein the bottom wall slopes downward and forward at about 10 to 20 degrees and wherein the front walls lopes rearward and downward at about 5 to 20 degrees from vertical, wherein the bottom wall is generally semi-circular around a similarly sloping imaginary axis, and further comprising a paddle wheel positioned adjacent the front wall and a shaft extending through the wall for supporting and driving the paddle wheel for lifting ice to a dispensing opening, and a speed reducer connected to the shaft and a drive motor connected to the speed reducer near a bottom of a front wall for driving the speed reducer and the shaft, wherein the speed reducer and drive motor are positioned rearward of a vertical plane from a top of a front wall of the dispenser, an opening in the front wall adjacent an upper portion of the paddle wheel and a solenoid-controlled gate in the opening, the gate being slideable between an open position and a closed position, a track surrounding the gate and a drain tube connected to a lower portion of the track for draining water from the track.

20. Ice dispensing apparatus comprising an ice storage bin having a rear wall and a front wall spaced from the rear wall, and first and second opposite side walls spaced from each other and connected to the front wall and rear wall, and a bottom wall connected to the side walls and connected to the front wall and rear walls for completing the ice storage bin, a circular recess in the front wall, plural ice dispenser paddles in the recess, a rotatable holder connected to the paddles, the rotatable holder being mounted on the front wall concentrically with the recess, an ice dispensing opening in an upper portion of the recess for permitting ice to flow through the opening and exit the recess, and a turner for turning the holder and moving the paddles in the recess, whereby the paddles move ice along the recess.

21. The apparatus of claim 20, wherein the holder comprises a circular plate mounted along a front wall concentrically with the recess.

22. The apparatus of claim 21, wherein the holder further comprises a circular portion connected to the plate and extending into the recess.

23. The apparatus of claim 22, wherein the paddles are curved.

24. The apparatus of claim 20, further comprising a drain at a bottom of the recess at a forward end of the lower wall.

25. The apparatus of claim 20, wherein the recess is arcuate over a major portion of a circle, and wherein the lower wall of the bin forms the lower surface of the recess.

26. The apparatus of claim 25, wherein the recess diverges from the side walls at points spaced upward along the front wall.

27. The apparatus of claim 20, wherein a shaft extends through the front wall concentrically with the recess and is secured to the holder inside of the front wall.

28. An ice dispensing apparatus comprising an ice storage bin having an outward and upward sloping inner wall, the inner wall having a fixed sloping surface, a paddle wheel mounted along the sloping wall and having a shaft disposed at an angle to a horizontal axis, a disk connected to the shaft means, a paddle support means connected to the disk for supporting ice-moving paddles, and ice-moving paddles connected to the paddle support and extending outward therefrom, the ice-moving paddles being configured for moving ice along the fixed sloping surface of the ice bin inner wall, thereby the paddles move ice along the fixed sloping surface of the inner wall, wherein the disk comprises a circular plate, wherein the paddle support comprises a forward extending plate attached to and extending forward of a circumferentially area of the circular plate and wherein the paddles are attached to the forward extending plate, and wherein the paddles curved rearward in a direction of rotation of the circular plate and forward in an axial direction, wherein the paddles terminate short of a front edge of the forward extending plate.

29. An ice dispensing apparatus comprising an ice storage bin having an outward and upward sloping inner wall, the inner wall having a fixed sloping surface, a paddle wheel mounted along the sloping wall and having a shaft disposed at an angle to a horizontal axis, a disk connected to the shaft means, a paddle support means connected to the disk for supporting ice-moving paddles, and ice-moving paddles connected to the paddle support and extending outward therefrom, the ice-moving paddles being configured for moving ice along the fixed sloping surface of the ice bin inner wall, whereby the paddles move ice along the fixed sloping surface of the inner wall, wherein the disk comprises a circular plate and wherein the paddle support comprises a forward extending plate attached to and extending forward of a circumferential area of the circular plate and wherein the paddles are attached to the forward extending plate, wherein a sloping wall has a cylindrical recess and the circular plate fits against a circular portion of a front wall of an ice dispenser bin, wherein the forward extending plate extends over a cylindrical wall portion of the recess in the sloping wall of the ice storage bin, and wherein the paddles move within the recess.

30. The apparatus of claim 29, further comprising a drain at the bottom of the recess in the front wall and an ice dispensing opening near a top of the recess in the front wall.

31. The apparatus of claim 30, wherein the front wall is sloped downwardly, rearwardly and inwardly in the bin.

32. The apparatus of claim 31, wherein the front wall is sloped rearwardly and inwardly about 20 degrees with respect to vertical.

33. The apparatus of claim 31, further comprising a solenoid operated gate in front of the opening, the gate moving from an open position to a closed position in front of the opening.

34. The apparatus of claim 31, further comprising an external recess in the outside of the sloping wall within the cylindrical recess in the inside of the sloping wall, and further comprising a motor and gear drive mounted within the external recess and connected to the shaft.

35. The apparatus of claim 34, further comprising an ice bridge breaker angularly extending from the shaft within the bin.

36. The apparatus of claim 35, wherein the ice bridge breaker comprises an extension extending rearward from the paddle wheel shaft and drivingly connected thereto, and an ice bridge breaker arm angularly connected to the extension.

37. The apparatus of claim 31, wherein the sloping wall is a front wall and the ice storage bin has generally vertical side walls connected to the front wall and having a curved bottom wall connected to the side walls and the front wall, the bottom wall sloping downward and forwardly toward the front wall, and the bin having a rear wall extending generally upwardly from a rear edge of the bottom wall and connected to rear edges of the side walls, and wherein the bottom wall is curved and generally tangentially joins the side walls.

38. The apparatus of claim 37, wherein the bottom wall slopes downwardly from the rear wall to the front wall.

39. The apparatus of claim 37, wherein the paddles have leading edges that curve away from the circular plate.

40. Ice dispenser apparatus comprising a bin having a rear wall, side walls, a bottom wall and a front dispensing wall, wherein a surface of the front wall facing inward in the bin has an arcuate forward extending recess communicating with the bin and extending forward into the front wall, and further comprising a paddle wheel having paddles positioned in the recess and a drive connected to the paddle wheel for moving the paddles in the recess, an ice dispensing opening in the recess near a top of the recess, whereby the paddles move ice along the recess toward the ice dispensing opening.

41. An ice dispensing apparatus comprising an ice storage bin having an outward and upward sloping inner wall, the inner wall having a fixed sloping surface, a paddle wheel mounted along the sloping wall and having a shaft disposed at an angle to a horizontal axis, a disk connected to the shaft means, a paddle support connected to the disk for supporting ice-moving paddles, and ice-moving paddles connected to the paddle support and extending outward therefrom, the ice-moving paddles being configured for moving ice along the fixed sloping surface of the ice bin inner wall, whereby the paddles move ice along the fixed sloping surface of the inner wall.

42. The apparatus of claim 40, wherein the recess is generally annular and wherein the drive comprises a shaft extending through a center of the annular recess, wherein the paddle wheel comprises a circular plate connected to the shaft and overlying the front wall in an area within the annular recess and wherein the paddles extend into the recess from the plate.

43. The apparatus of claim 42, wherein the paddle wheel further comprises a forward extending plate extending into the recess from a peripheral circumferential area of the circular plate, and wherein the paddles are connected to the forward extending plate and extend radially outward from the forward extending plate.

44. The apparatus of claim 40, wherein the bottom wall of the ice hopper is concave and slopes forwardly and downwardly at an angle of about 10 to 20 degrees to horizontal.

45. THe apparatus of claim 44, wherein the front wall recess is cylindrically shaped, and wherein the concave bottom wall has a curvature which is substantially semicircular, and wherein the front wall slopes forwardly and upwardly from a position spaced by the recess from the bottom wall at an angle of about 10 to 20 degrees to vertical.

46. Ice dispenser apparatus comprising a bin having a rear wall, side walls, a bottom wall and a front dispensing wall, an arcuate recess in the front wall wherein the bottom wall slopes downward and forward at about 10 to 20 degrees, and wherein the front wall slopes rearward and downward at about 5 to 20 degrees from vertical, further comprising a paddle wheel positioned adjacent the front wall and having paddles in the recess for moving ice along the recess, and a shaft extending through the wall for supporting and driving the paddle wheel for lifting ice to a dispensing opening.

47. An ice dispensing bin having an open top, and a cover for the top, a long generally vertical rear wall extending downward from the top, a sloping bottom wall extending downward and forward from a lower edge of the rear wall, a generally vertical upper front wall portion extending downward from the top, a sloping front wall portion extending downward and rearward from a lower edge of the vertical upper front wall portion toward the sloping bottom, a first and second oppositely spaced sidewalls connected to lateral edges of the rear wall, the bottom wall, the upper portion of the front wall and the sloping portion of the front wall, and a dispensing opening in an upper portion of the sloping portion of the front wall for dispensing ice out of the bin, and ice mover mounted in the bin adjacent the sloping portion of the front wall and extending between positions near a forward portion of the bottom sloping wall and the dispensing opening for moving ice along he sloping front wall to the dispensing opening, whereby substantially all of the ice within the bin is capable of being dispensed from the dispensing opening by the ice mover, further comprising a circular recess extending forward within the sloping portion of the front wall, and wherein the ice mover includes paddles mounted within the forward extending recess for moving ice along the recess, whereby substantially all of the ice in the bin is dispensed by the paddles moving along the recess, and whereby the ice is dispensed at a substantially consistent rate.

* * * * *

UNITED STATES PATENT AND TRADEMARK OFFICE

CERTIFICATE OF CORRECTION

PATENT NO. : 4,930,685

DATED : June 5, 1990

INVENTOR(S) : Jerry L. Landers

It is certified that error appears in the above-identified patent and that said Letters Patent is hereby corrected as shown below:

Column 7, line 37, "walls lopes" should read --wall slopes--.

Column 8, line 35, "thereby" should read "whereby".

Column 8, line 39, "circumferentially" should read "circumferential".

Signed and Sealed this

Eighth Day of February, 1994

*Attest:*

*Attesting Officer*

BRUCE LEHMAN

*Commissioner of Patents and Trademarks*